US008425280B2

(12) United States Patent
Siepi et al.

(10) Patent No.: US 8,425,280 B2
(45) Date of Patent: Apr. 23, 2013

(54) DISTRIBUTOR FOR CONTINUOUSLY FEEDING ABRASIVE MATERIAL IN A WATER-JET CUTTING MACHINE

(75) Inventors: Marco Siepi, Pesaro (IT); Matteo Traini, Pesaro (IT); Marco Belli, Pesaro (IT)

(73) Assignee: Biesse S.p.A., Pesaro (IT)

( * ) Notice: Subject to any disclaimer, the term of this patent is extended or adjusted under 35 U.S.C. 154(b) by 433 days.

(21) Appl. No.: 12/892,255

(22) Filed: Sep. 28, 2010

(65) Prior Publication Data

US 2011/0081842 A1 Apr. 7, 2011

(30) Foreign Application Priority Data

Sep. 28, 2009 (IT) ..... TO2009A000732

(51) Int. Cl.
*B24B 19/00* (2006.01)

(52) U.S. Cl.
USPC ..... 451/99; 451/101; 451/102; 451/60; 451/446

(58) Field of Classification Search ..... 451/99, 451/101, 102, 60, 446
See application file for complete search history.

(56) References Cited

U.S. PATENT DOCUMENTS

| | | | | | |
|---|---|---|---|---|---|
| 2,846,820 | A * | 8/1958 | Persak, Jr. et al. | ..... | 451/77 |
| 3,852,918 | A * | 12/1974 | Black | ..... | 451/99 |
| 3,972,150 | A * | 8/1976 | Hart | ..... | 451/90 |
| 4,827,679 | A | 5/1989 | Earle, III | | |
| 4,936,059 | A * | 6/1990 | Hashish et al. | ..... | 451/99 |
| 5,109,631 | A * | 5/1992 | Biebesheimer et al. | ..... | 451/262 |
| 5,197,230 | A * | 3/1993 | Simpfendorfer et al. | ..... | 451/11 |
| 5,349,788 | A | 9/1994 | Nedo et al. | | |
| 5,582,537 | A * | 12/1996 | Keller | ..... | 451/76 |
| 5,605,492 | A * | 2/1997 | Klingel | ..... | 451/40 |
| 5,992,404 | A * | 11/1999 | Bleyer et al. | ..... | 125/26 |
| 6,200,202 | B1 * | 3/2001 | Eastman et al. | ..... | 451/99 |
| 6,200,203 | B1 * | 3/2001 | Xu et al. | ..... | 451/99 |
| 6,283,832 | B1 * | 9/2001 | Shepherd | ..... | 451/40 |
| 6,824,450 | B2 * | 11/2004 | Opel | ..... | 451/53 |
| 2004/0259478 | A1 | 12/2004 | Hashish et al. | | |
| 2008/0277118 | A1 * | 11/2008 | McAfee | ..... | 166/298 |

FOREIGN PATENT DOCUMENTS

| | | |
|---|---|---|
| WO | WO 2008/128303 | 10/2008 |
| WO | WO 2008/128303 A1 | 10/2008 |

OTHER PUBLICATIONS

European Search Report issued Mar. 14, 2011 in connection with EP App No. 10178185.4.
Italian Search Report for Italian Patent Application No. TO2009A000732, dated May 21, 2010.
Italian Written Opinion for Italian Patent Application No. TO2009A000732, dated Sep. 28, 2009, 6 pages.

* cited by examiner

*Primary Examiner* — George Nguyen
(74) *Attorney, Agent, or Firm* — Nixon & Vanderhye P.C.

(57) ABSTRACT

A machine has a head with a nozzle, a pipe for supplying water under pressure to the nozzle, and a duct for supplying an abrasive agent, and adding it to the jet of water under pressure. The duct has a first duct portion, fixed with respect to the head in the movements of rotation about a main axis, and a second duct portion, which is fixed with respect to the movements of rotation. A rotating distributor connects the first rotating portion with the second fixed portion of the duct for supplying the abrasive agent. The distributor's stator and rotor are rotatably mounted on one another without the interposition of seal rings and define between them an internal chamber that is substantially at atmospheric pressure and from which the abrasive agent drops by gravity to a duct outlet that converges into the pipe for supplying water under pressure.

4 Claims, 4 Drawing Sheets

DISTRIBUTOR FOR CONTINUOUSLY FEEDING ABRASIVE MATERIAL IN A WATER-JET CUTTING MACHINE

This application claims priority to IT Application No. TO2009A000732 filed 28 Sep. 2009, the entire contents of which is hereby incorporated by reference.

The present invention relates to machines for cutting with a jet of water with the addition of abrasive material for machining glass, stone, or other materials, of the type comprising one or more cutting heads, which moves along one or more axes and includes a nozzle for emission of a jet of water at extremely high pressure, a pipe extending along a main axis of the head, about which the head is able to turn, for supplying water under pressure to the nozzle, and a duct for supplying to the nozzle the abrasive, for example garnet, which is added to the jet of water under pressure.

In the machines of the type specified above, the addition of the abrasive agent to the jet of water at high pressure enables execution of cutting also on materials with a high degree of hardness.

At the current state of the art, in the aforesaid machines the cutting head is mobile along three mutually orthogonal axes conventionally designated by the letters X, Y, Z and, if required, along a further two axes, one of which is the axis of rotation about the aforesaid main axis, conventionally designated by the letter C and referred to as "fourth axis" and the other intersects the preceding one according to a variable angle, positioned at which is the nozzle for concentration and mixing of the water at extremely high pressure with the abrasive, said axis being commonly designated by the letter B and referred to as "fifth axis".

In the aforesaid machine, the abrasive is conveyed by means of a flexible pipe set on the outside of the axis Z and of the head, which is subject to bending and torsion following upon the movements of the axis C and of the axis B, with the consequence that the rotation about the aforesaid fourth axis can be performed only in finite mode, i.e., for a maximum angle of approximately 360° or slightly greater, without any possibility of continuous rotation for a number of turns. Said limit in various cases determines a disadvantage above all in terms of quality of the cutting operation on account of the need to make brief stops during machining in order to reposition the nozzle to prevent twisting of the pipe for delivery of the abrasive. Said stops determine a greater abrasion of the material and a consequent lack of constancy of the quality of the cut.

WO 2008/128303 A1 shows a machine for cutting with hydro-abrasive jet, comprising a cutting head including a nozzle for emission of a jet of water under pressure, a pipe extending along a main axis of the head about which the head is able to turn, for supplying water under pressure to the nozzle, and a duct for supplying an abrasive agent and adding it to the jet of water under pressure. The duct for the abrasive agent comprises a first portion of duct fixed with respect to with the head in the movements of rotation about said main axis and a second portion of duct, which is, instead, fixed with respect to said movements of rotation, and a rotating distributor is provided, which connects said first, rotating, portion to said second, fixed, portion of the duct for supplying the abrasive agent.

The main drawback of this known solution lies in that the distributor comprises a stator and a rotor rotatably mounted with respect to one another with the interposition of seal rings. This arrangement is necessary in so far as the abrasive material is forced under pressure towards the outlet from the duct for the abrasive material. However, the relative rotation of the aforesaid elements, in the presence of abrasive material, leads to an early wear of the seal rings, which in effect renders said solution inapplicable.

The object of the present invention is to overcome the aforesaid drawback.

According to its main characteristic, the invention enables solution of the problem described above by that said rotating distributor comprises a stator connected to the fixed portion of the duct and a rotor connected to the rotating portion of the duct, and that said stator and said rotor are rotatably mounted on one another without the interposition of seal rings and define between them an internal chamber which communicates with both of the aforesaid duct portions and is substantially at atmospheric pressure and from which the abrasive agent descends simply by gravity down to an outlet of said duct for the abrasive agent that converges into said pipe for supplying water under pressure.

Thanks to the aforesaid characteristics, during the rotations of the head about the aforesaid main axis the portion of the duct for delivery of the abrasive agent that is fixed with respect to the rotating part of the head turns with the latter about the aforesaid main axis, whilst the aforesaid rotating distributor ensures continuous delivery of the abrasive agent maintaining the communication between said rotating portion of the duct and the fixed portion of the duct. Since supply of the abrasive material is simply entrusted to the gravity, the stator and the rotor of the distributor are rotatably mounted with respect to one another without the interposition of seal rings, so that the drawback of poor reliability and short service life inherent in the known solution discussed above is radically eliminated.

In this way, moreover, the machine according to the invention enables rotations of the head about the aforesaid main axis also for an infinite number of turns during execution of the cutting operation, without any need to make stops that would cause a lack of uniformity of the quality of the cut.

In a preferred embodiment, the invention applies to a machine of the type mentioned above, where the head is mobile along three mutually orthogonal axes X, Y, Z and is moreover able to turn both about the aforesaid main axis, which functions as fourth axis, and about a fifth axis that intersects the fourth axis according to a variable angle.

Of course, the invention is in any case applicable to any type of water-cutting machine, whatever the architecture and the functionality of the machine.

The invention will now be described with reference to the annexed drawings, which are provided purely by way of non-limiting example and in which.

Figure 1:
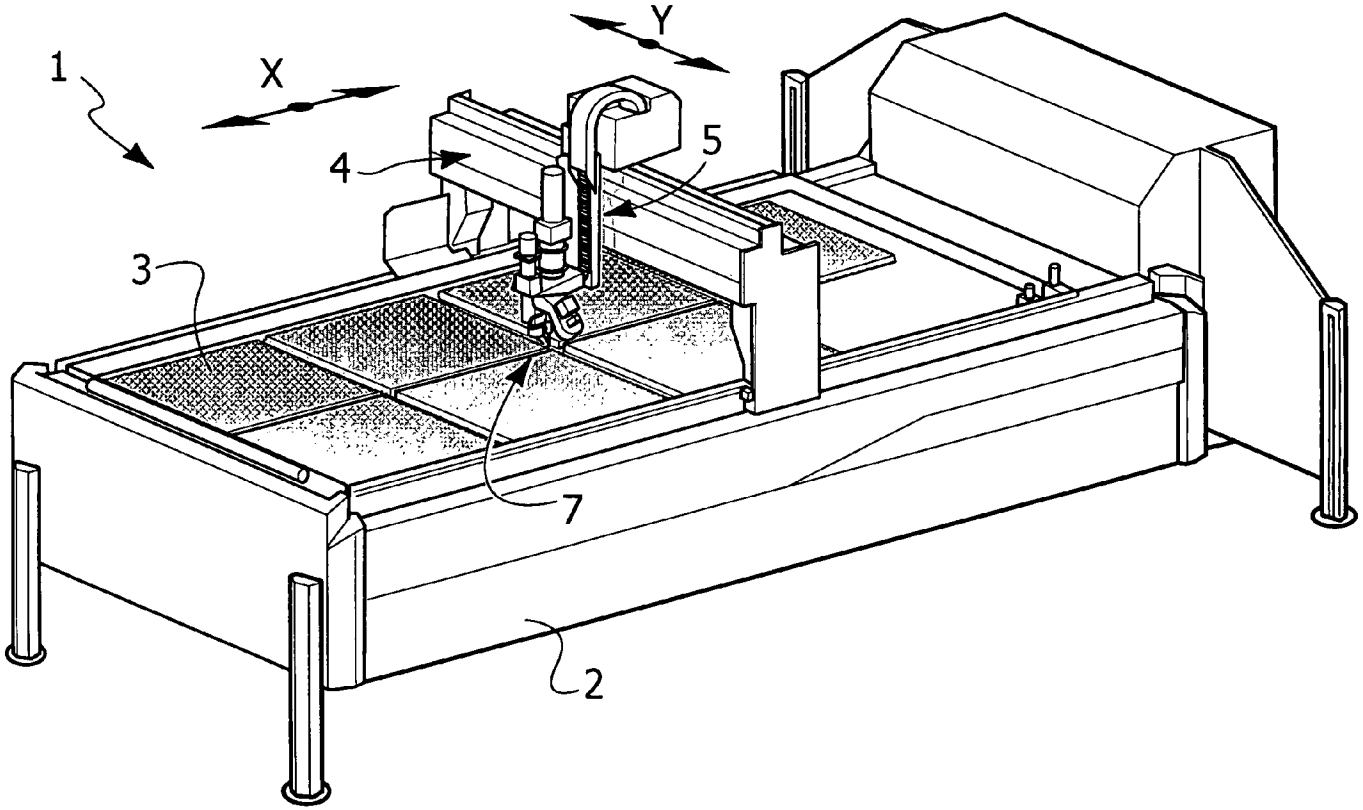
FIG. 1 is a schematic perspective view of a preferred embodiment of the machine according to the invention.

With reference to FIG. 1, the number 1 designates as a whole a water-cutting machine to which the invention can, for example, be applied. The machine 1 comprises a fixed bench 2, defining a resting surface 3 for the workpieces. A cross-member 4 is set above the surface 3 and is, slidably mounted, like a bridge crane, on guides provided along the two side walls of the bench 2. The reference number 5 designates a carriage, slidably mounted on the cross-member 4 in the longitudinal direction Y of the cross-member, the longitudinal direction of the bench 2 along which the cross-member 4 is displaceable being designated by X. As may be seen more clearly in FIG. 2, the carriage 5 supports in a slidable way along a vertical axis Z a slide 6 carrying a machining head, designated as a whole by the reference number 7 (see also FIG. 3).

The head 7 comprises a nozzle 8 for delivery of a jet of water at high pressure. The structure of the nozzle 8 is carried by the slide 6, which is able to move in Z via interpositions of two further axes of rotation. In particular, once again with reference to the example illustrated, the slide 6 supports in cantilever fashion a support 9, which carries in rotation an underlying structure 10 of the head 7 about a main axis 11, parallel to the vertical direction Z, which constitutes the fourth axis of the machine. The structure 10 is elbow-shaped and supports an underlying support 12 (see in particular FIG. 3), to which the nozzle 8 is connected in such a way that it can turn about a fifth axis 13 that intersects the axis 11 with a variable angle A.

Figure 4:
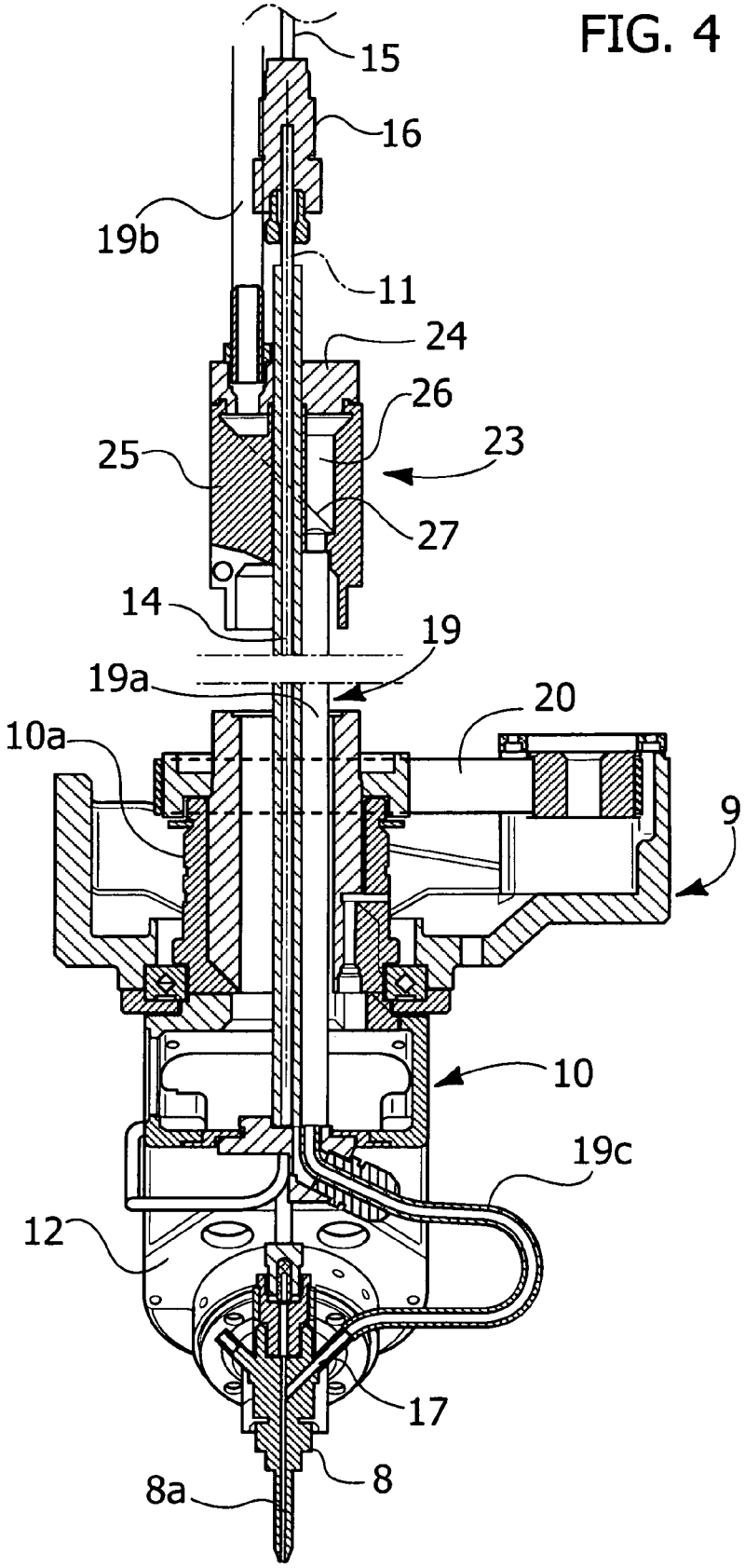
FIG. 4 is a schematic cross-sectional view of the assembly shown in FIG. 2.

With reference also to FIG. 4, the nozzle 8 has an axial passage 8*a* for delivery of a jet of water at high pressure, which receives the water under pressure from a pipe 14 extending along the axis 11 and carried by the structure 10 rotating about said axis. The pipe 14 consequently turns with the structure 10 about the axis 11 during the movements of orientation of the head. Once again with reference to FIG. 4, the top end of the pipe 14 is in communication with a non-rotating pipe 15 via a rotary joint 16. The means set upstream of the pipe 15, for supplying the water at high pressure are not illustrated in the annexed drawings and can be obtained in any known way.

Inserted in the body of the nozzle 8 is a prod-like end 17 of a duct 19 for delivery of an abrasive agent, specifically garnet, to the jet of water at high pressure. The internal passage of the body of the nozzle 8 in which the prod 17 is inserted converges in the axial passage 8*a* in such a way that the flow of sand that is fed downwards by gravity is drawn into the flow of water under pressure by an ejecting effect (Venturi effect).

Figure 2:
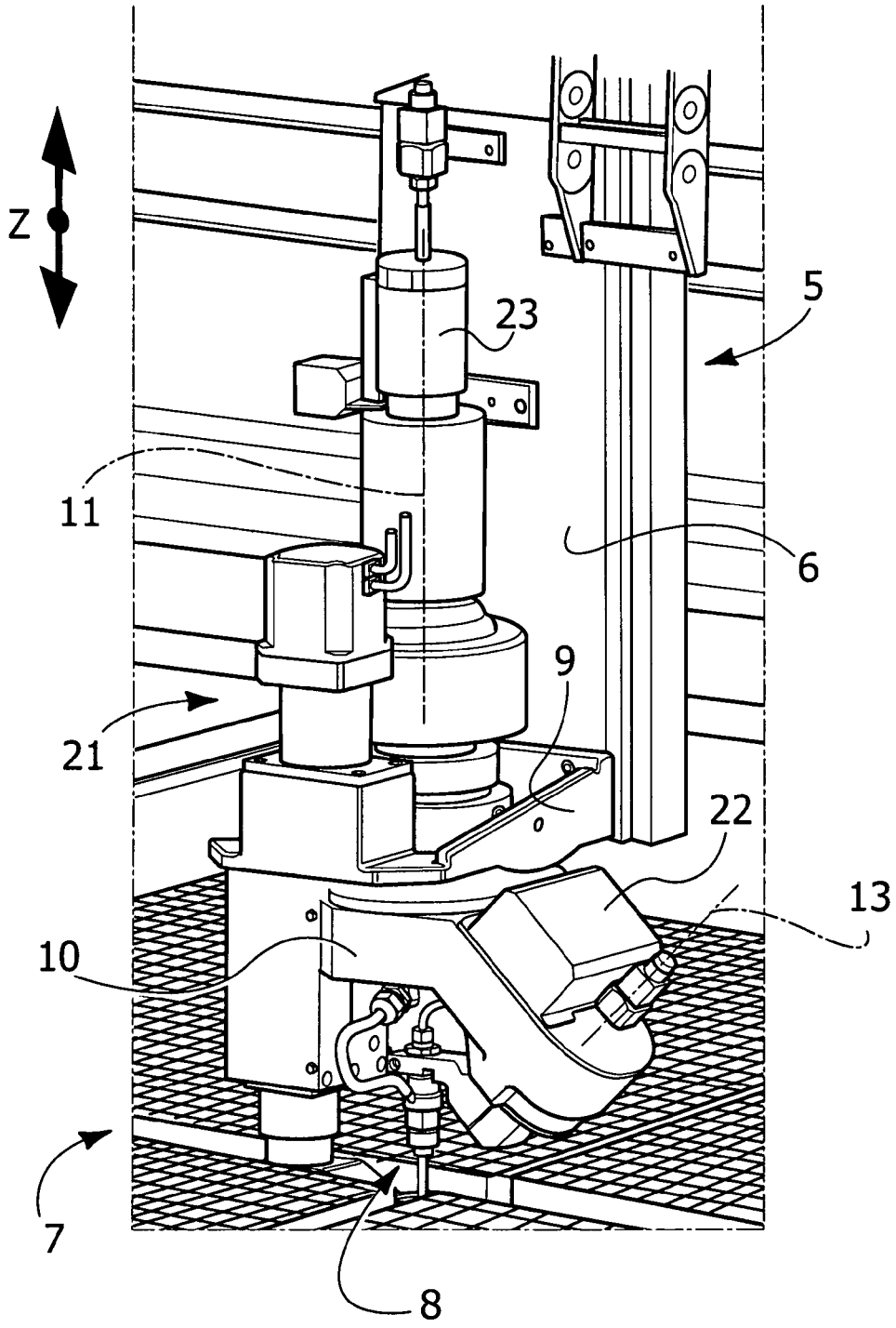
FIG. 2 illustrates at an enlarged scale a detail of FIG. 1.
Figure 3:
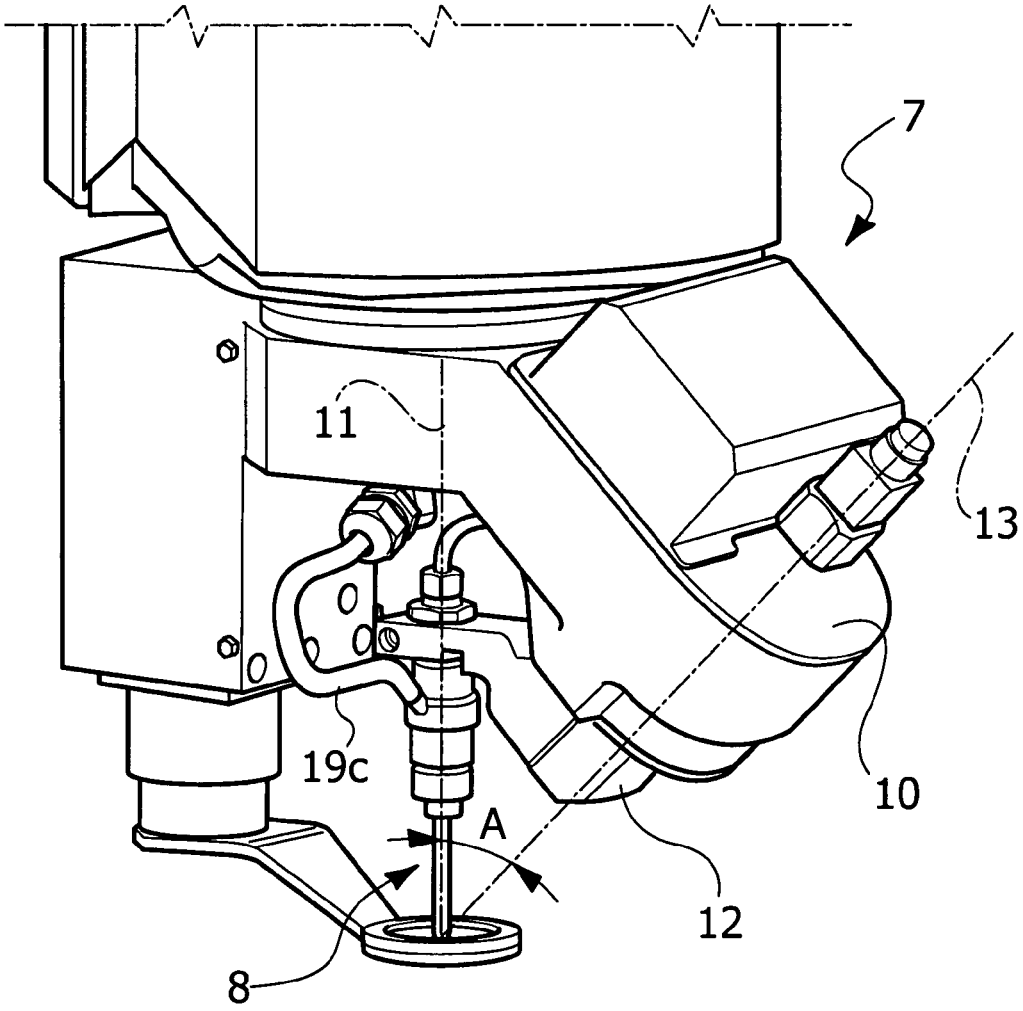
FIG. 3 illustrates at a further enlarged scale a detail of FIG. 2.

According to a main aspect of the present invention, the duct 19 for supplying the abrasive comprises a duct portion 19*a*, which is fixed to the structure 10 with respect to rotations about the axis 11, and a portion 19*b*, which is, instead, fixed with respect to rotations about the axis 11, since it is fixed with respect to the slide 6. In the case of the example illustrated, the first portion 19*a* of the duct extends parallel and immediately adjacent to the pipe 14 for the water along the axis 11, so that during the rotations of the structure 10 about the axis 11 the portion 19*a* of the duct 19 turns like a satellite about the pipe 14 for the water. Also visible in FIG. 4 is part of the structure of the support 9 fixed to the slide 6 and the belt transmission 20 contained therein, by means of which the rotation of a top part 10*a* of the structure 10 is governed by an electric motor 21 (visible in FIG. 2). FIGS. 2, 3 show also part of the assembly 22 for control of the rotation of the support 12 about the fifth axis 13.

Once again with reference to FIG. 4, the reference number 23 designates a rotating distributor, which connects the rotating portion 19*a* of the duct 19 for the sand with the fixed portion 19*b*. The rotating distributor 23 comprises a stator body 24, rigidly connected to the bottom end of the fixed portion 19*b* of the duct 19, and a rotor body 25 (see also FIG. 2), connected in rotation to an internal cavity 26, which is in turn connected in rotation about the axis 11, with respect to the structure 9, to the structure 10. The stator 24 and the rotor 25 are rotatably mounted with respect to one another and define between them the internal cavity 26, which is in communication with both of the duct portions 19*a*, 19*b*. The cavity 26 has an inclined bottom wall 27 that enables convey-ance of the sand coming from the fixed portion 19*b* of the duct towards the outlet of the distributor that is aligned with the rotating portion 19*a*.

As already illustrated above, the cavity or chamber 26 of the rotating distributor is substantially at atmospheric pressure, and the abrasive material is supplied simply by gravity from the chamber 26 as far as the outlet of the duct 19 that converges into the passage 14 for the water. From this standpoint, particularly advantageous is the inclined surface 27, which thus performs the function of hopper. The stator and the rotor of the distributor are rotatably mounted with respect to one another without interposition of seal rings, so that the problem of reliability and service life linked to the wear of said seal rings is solved at the root, without jeopardizing supply of the abrasive material, given that the chamber 26 is not under pressure.

Thanks to the structure and to the arrangement described above, supply of sand is ensured continuously during the cutting operation, without jeopardizing the possibility of continuous rotation of the structure 10 of the head about the aforesaid main axis 11, or fourth axis, and without any impediment due to the presence of the duct for delivery of the abrasive.

As may be seen in FIG. 4, the bottom end of the portion 19*a* of the duct extends into a flexible pipe 19*c* for connection to the end prod 17 inserted in the body of the nozzle.

As is evident from the foregoing description, the machine according to the invention does not require frequent stops during the cutting operation as, instead, is the case of known machines and consequently guarantees a high uniformity of the quality of the cut. Operation of the machine is in general more reliable, without involving, on the other hand, any significant constructional complication.

As already mentioned, the invention is of course applicable to any configuration and architecture of cutting machine which uses a jet of water under pressure with the addition of a flow of abrasive, for example garnet.

Of course, without prejudice to the principle of the invention, the details of construction and the embodiments may vary widely with respect to what has been described and illustrated herein purely by way of example, without thereby departing from the scope of the present invention.

The invention claimed is:

1. A machine for cutting, with hydro-abrasive jet, materials such as, for example, glass, stone, granite, marble, metals in general, and any other material that can be machined with the aforesaid technology, comprising one or more cutting heads (7) mobile according to one or more axes (X, Y, Z, 11, 13) and including:

a nozzle (8) for emission of a jet of water under pressure;

a pipe (14) extending along a main axis (11) of the head (7), about which the head (7) is able to turn for supplying water under pressure to the nozzle; and a duct (19) for supplying an abrasive agent and adding said abrasive agent to the jet of water under pressure, wherein said duct (19) for the abrasive agent comprises a first duct portion (19*a*), fixed with respect to the head (7) in the movements of rotation about said main axis (11), and a second duct portion (19*b*), which is fixed with respect to said movements of rotation, and wherein a rotating distributor (23) is provided, which connects said first, rotating, portion (19*a*) to said second, fixed, portion (19*b*) of the duct (19) for supplying the abrasive agent, wherein said rotating distributor (23) comprises a stator (24), connected to the fixed portion (19*b*) of the duct (19), and a rotor (25), connected to the rotating portion of the duct (19), and in that said stator (24) and said rotor (25) are rotatably mounted on one another without the interposition of seal rings and define between them an internal chamber (26) which communicates with both of the aforesaid duct portions and is substantially at atmospheric pressure, and from which the abrasive agent descends simply by gravity down to an outlet of said duct (19) for the abrasive agent that converges into said pipe (14) for supplying water under pressure.

2. The machine according to claim 1, wherein said internal chamber (26) of the rotating distributor (23) has a wall (27) that is able to convey the abrasive agent from the end of the distributor, which communicates with said portion of fixed duct (19*b*), to the end of said distributor, which communicates with said rotating portion (19*a*) of said duct (19).

3. The machine according to claim 1, wherein said cutting head (7) is carried by a slide (6), which is mobile in a vertical direction (Z) on a carnage (5) that is mobile in the longitudinal direction (Y) of a horizontal cross-member (4), slidably mounted on the side walls of a fixed bench (2) in a horizontal direction (X) orthogonal to the two aforesaid directions (Y, Z), said fixed bench (2) defining a horizontal resting surface (3) for the workpiece.

4. The machine according to claim 1, wherein said abrasive agent is garnet.

* * * * *